US005765700A

United States Patent [19]

Donne

[11] Patent Number: 5,765,700

[45] Date of Patent: Jun. 16, 1998

[54] GOURMET POT AND PAN SUPPORT

[76] Inventor: Donald E. Donne, 4202 S. Carey St., Marion, Ind. 46953

[21] Appl. No.: 802,238

[22] Filed: Feb. 19, 1997

[51] Int. Cl.[6] ..... A47F 5/00

[52] U.S. Cl. ..... 211/85.31; 211/181.1; D6/458; 248/175

[58] Field of Search ..... 211/181.1, 205, 211/85.31, 70.7, 119, 71.01, 70, 41.11; D6/462, 486, 487, 449, 458; 248/175

[56] References Cited

U.S. PATENT DOCUMENTS

| | | | |
|---|---|---|---|
| D. 134,110 | 10/1942 | Bersin et al. | D6/458 |
| D. 250,686 | 1/1979 | Ashcraft | D6/458 |
| D. 298,193 | 10/1988 | Carlson | D6/462 |
| D. 351,959 | 11/1994 | Klein | D6/487 |
| D. 361,224 | 8/1995 | Stanley | D6/458 |
| 710,805 | 10/1902 | Riley | 211/181.1 X |
| 933,142 | 9/1909 | Vogt | 211/181.1 X |
| 1,485,852 | 3/1924 | Jarvis | 211/181.1 X |
| 1,754,998 | 4/1930 | Geavtts | 211/205 X |
| 5,094,352 | 3/1992 | Green et al. | 211/59.1 X |

*Primary Examiner*—Robert W. Gibson, Jr.
*Attorney, Agent, or Firm*—Daniel J. O'Connor

[57] ABSTRACT

A stand or rack specifically designed for the display of gourmet pots and pans. The structure includes a circular base and curved supporting arms for maximum stability of the unit. The invention provides enhanced access to and display of the pots and pans. The device may be economically manufactured and sold for widespread domestic and commercial uses.

1 Claim, 1 Drawing Sheet

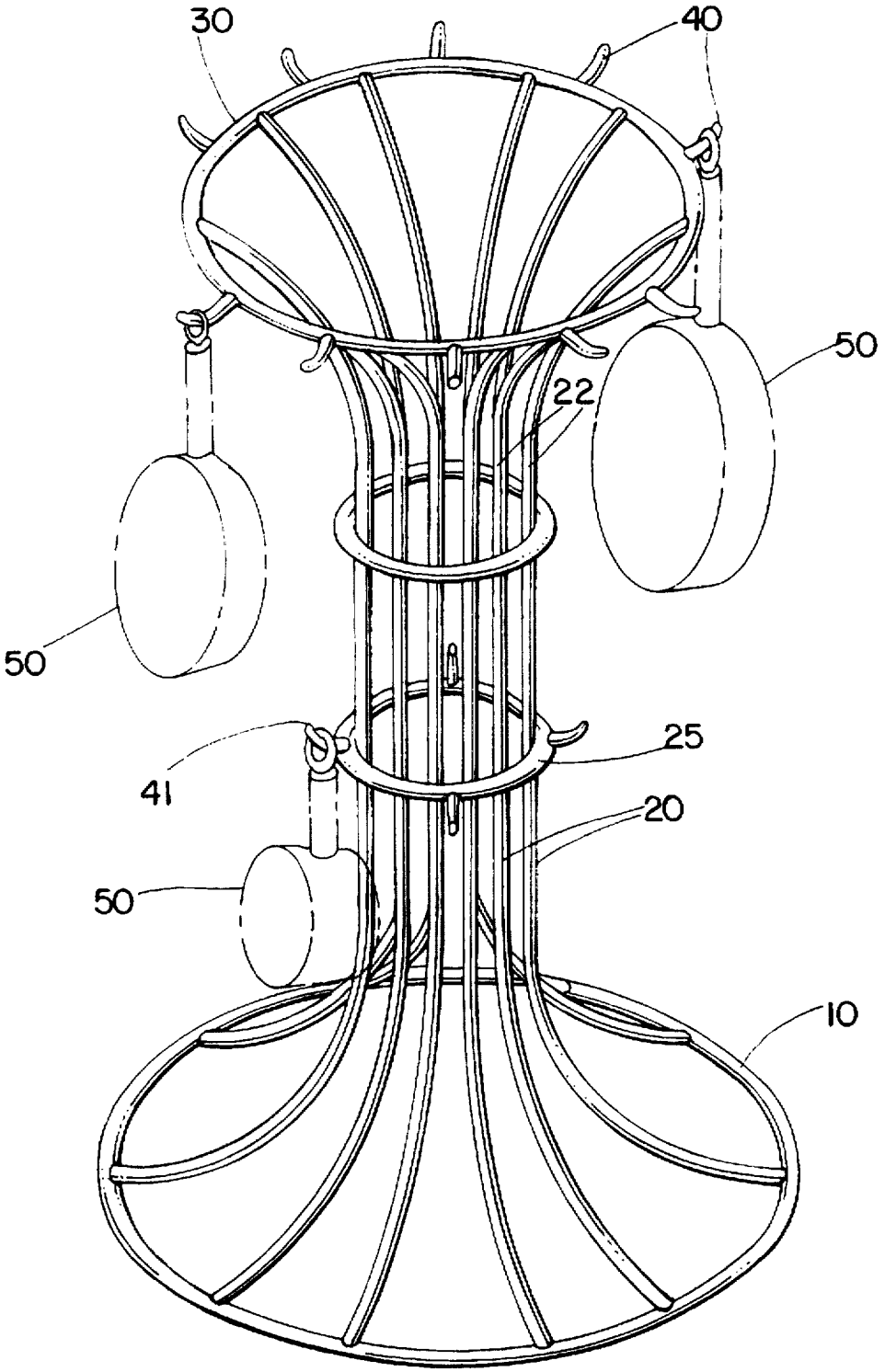
30
40
50
22
50
25
41
20
50
10

GOURMET POT AND PAN SUPPORT

BACKGROUND AND OBJECTS OF THE INVENTION

U.S. Pat. No. 5,094,352 illustrates the state of the prior art related to supporting devices for pots and pans and like articles.

The prior art designs have been effective for storage purposes but have not been widely marketed as effective display items for gourmet pots and pans.

Prior art designs have also proven to be relatively costly to manufacturer and sell and have thus not found widespread acceptance in the art.

Prior art designs have also proven to be unstable and difficult to use in practice.

Accordingly, it is an object of the present invention to demonstrate a novel support for gourmet pots and pans which effectively and attractively displays such pots and pans.

It is a further object of the invention to show a novel support which may be economically manufactured for widespread commercial distribution.

It is a still further object of the invention to set forth a novel support design which is highly stable in use for enhanced safety for the consumer.

It is also an object of the invention to demonstrate a gourmet pot and pan support which is of highly durable construction for a longer use life by the consumer.

These and other objects and advantages of the present invention will be appreciated by those of skill in the support and display arts.

SUMMARY OF THE INVENTION

The design is 4–5' tall floor-standing structure which is fabricated of metal or other high-durability materials.

A widened base provides for unit stability while a narrower middle portion enables the pots and pans to be fully displayed without using excess space.

The see-through design allows the gourmet pots and pans to be effectively displayed and results in lower manufacturing costs by using fewer component parts.

DESCRIPTION OF THE DRAWING FIGURE

The drawing FIG. 1 shows an overall perspective view of the components of the invention.

DESCRIPTION OF THE PREFERRED EMBODIMENT

Referring to the drawing FIG. 1, the support rack of the present invention is shown as having a circular support base 10.

A plurality of inwardly curved support legs 20 extend upward from said base 10 to a median section which includes at least one support ring 25.

The upper part of the structure includes a plurality of outwardly extending arms 22 which are attached to an upper circular frame member 30.

A number of hooks 40 are attached to the overall structure to support the gourmet pots and pans 50. The hooks 40 may be extensions of the upper arms 22 or attached as separate components depending upon the particular manufacturing process being utilized.

The overall unit is comprised of metal or other high durability materials for long life of the structure.

The components are attached to each other by known mechanical means such as spot welding or conventional fasteners.

The legs 20 and arms 22 may be separate pieces or made as a one-piece unit.

As further shown in FIG. 1, the unit includes median hooks 41 to also support pans 50. Hooks 41 may be attached to the median support rings 25 or be placed at other middle portions of the overall unit.

In viewing FIG. 1, it will thus be appreciated that a see-through design is created wherein all of the gourmet pots and pans are visible in an attractive display while still being secured within and upon the unit.

The overall unit requires few component parts and may be easily assembled for economy of manufacture resulting in a relatively low-cost yet high-quality structure.

The design is highly stable by reason of the circular base and inwardly extending arms which render the unit nearly impossible to tip over.

The overall unit effectively saves space while attractively displaying the gourmet pots and pans.

While a particular embodiment has been shown and described, it is intended in this specification to cover all equivalent structures and designs which would reasonably occur to those of skill in the art.

I claim:

1. A support rack means for holding gourmet pots and pans comprising:

a circular support base(10), a plurality of lower, inwardly curved supporting legs(20) extending from said circular support to a plurality of outwardly curved upper supporting arms(22), said arms(22) extending to an upper circular frame member(30), a plurality of hook means(40) extending from said upper circular frame member for supporting a plurality of gourmet pots and pans(50), a median section between said lower legs and said upper arms having at least one support ring(25), at least one hook means(41) extending from said median section for supporting gourmet pots and pans, said supporting legs and arms providing means wherein a see-through display effect is created whereby all of the gourmet pots and pans are effectively shown, wherein said median section is of smaller diameter than said supporting base(10) to provide enhanced stability for the overall unit, wherein said upper circular frame member(30) is of larger diameter than said median section to allow said gourmet pots and pans to be effectively displayed, wherein said components are comprised of metal or other long-life material.

* * * * *